United States Patent [19]

Kay et al.

[11] 4,084,960

[45] Apr. 18, 1978

[54] METHODS OF DESULPHURIZING IRON AND STEEL AND GASES, SUCH AS STACK GASES AND THE LIKE

[75] Inventors: D. Alan R. Kay, Hamilton, Canada; William G. Wilson, Pittsburgh, Pa.

[73] Assignee: Molycorp, Inc., White Plains, N.Y.

[21] Appl. No.: 705,525

[22] Filed: Jul. 15, 1976

[51] Int. Cl.[2] ..... C21C 7/02

[52] U.S. Cl. ..... 75/58; 75/60

[58] Field of Search ..... 75/58, 60

[56] References Cited

U.S. PATENT DOCUMENTS

| | | | |
|---|---|---|---|
| 3,211,549 | 10/1965 | Kusaka | 75/123 E |
| 3,816,103 | 6/1974 | Link | 75/58 |

*Primary Examiner*—P. D. Rosenberg

*Attorney, Agent, or Firm*—Buell, Blenko & Ziesenheim

[57] ABSTRACT

A method for desulphurizing iron, steel, stack gases and the like is provided in which rare earth oxides are reacted, in the presence of an agent, such as carbon, vacuum, reducing gases, etc. for reducing the oxygen level, with the sulphur to be removed to form one of the group consisting of rare earth sulphides, rare earth oxysulphides and mixtures thereof.

10 Claims, 7 Drawing Figures

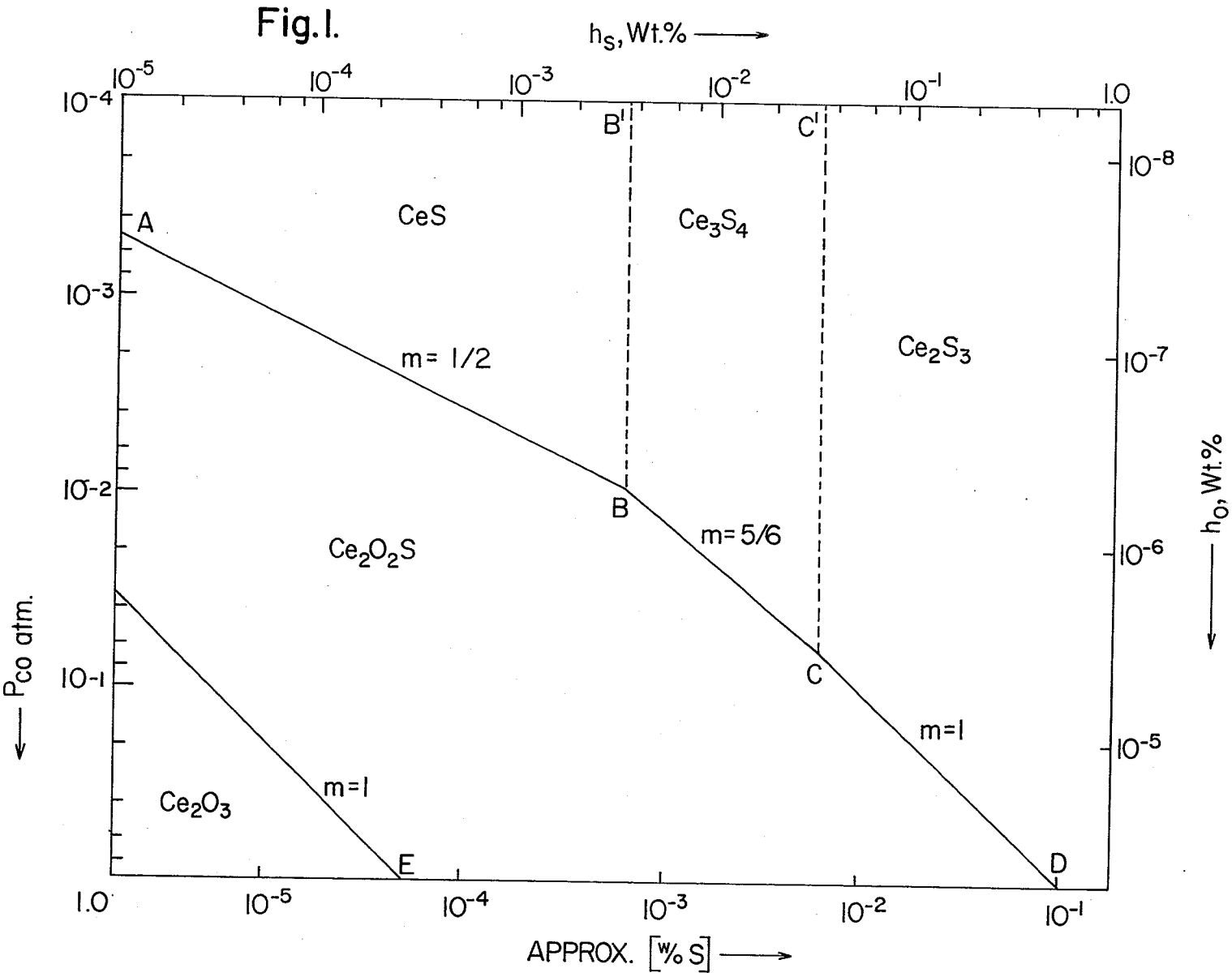
Fig. I.
$h_O$, Wt.%
$10^{-8}$
$10^{-7}$
$10^{-6}$
$10^{-5}$
$h_S$, Wt.%
1.0
$10^{-1}$
$10^{-2}$
$10^{-3}$
$10^{-4}$
$10^{-5}$
$P_{CO}$ atm.
$10^{-4}$
$10^{-3}$
$10^{-2}$
$10^{-1}$
1.0
APPROX. [% S]
$10^{-1}$
$10^{-2}$
$10^{-3}$
$10^{-4}$
$10^{-5}$
1.0
$Ce_2S_3$
$Ce_3S_4$
CeS
$Ce_2O_2S$
$Ce_2O_3$
m=1
m=5/6
m= 1/2
m=1
A
B'
C'
B
C
D
E

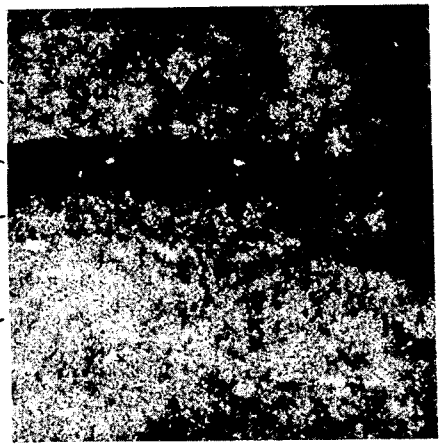
Fig. 2b Optical micrograph 200X.
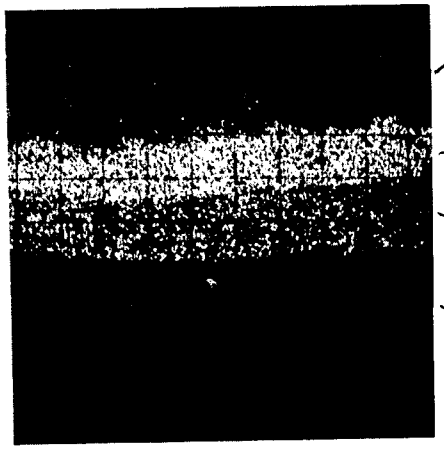
Fig. 2a X-ray sulphur microprobe image.

METHODS OF DESULPHURIZING IRON AND STEEL AND GASES, SUCH AS STACK GASES AND THE LIKE

This invention relates to methods of desulphurizing iron and steel and the like and particularly to a method of external desulpherizing iron and steel, stack gases, coal gases and the like using rare earth oxides.

External desulphurization of molten iron and steel has been practiced for quite some time. It is a recognized, even necessary practice, in much of the iron and steel produced today. In current practices for desulphurization magnesium metal, mag-coke, calcium oxide, calcium carbide or mixtures of calcium oxide and calcium carbide are generally used. Unfortunately, there are serious problems, as well as major cost items involved, in the use of all of these materials for desulphurization. Obviously, both CaO and $CaC_2$ must be stored under dry conditions, since CaO will hydrate and $CaC_2$ will liberate acetylene on contact with moisture. Magnesium is, of course, highly incendiary and must be carefully stored and handled. There are also further problems associated with the disposal of spent desulphurization slags containing unreacted $CaC_2$.

We have found that these storage, material handling and disposal problems are markedly reduced by using rare earth oxides in a low oxygen content bath of molten iron or steel. The process is adapted to the desulphurization of pig iron or steel where carbon monoxide, evolved by the reaction, where carbon is used as a deoxidizer, is diluted with an inert gas such as nitrogen or by vacuum degassing the melt in order to increase the efficiency of the reaction by reducing the likelihood of forming oxysulfides. The principle may also be used for desulphurizing stack gases from boilers, etc.

We provide a method of desulphurizing molten iron and steel as well as stack gases and the like by the steps of reacting rare earth oxide in the presence of a deoxidizing agent with the sulphur to be removed to form one of the group consisting of rare earth sulphide and rare earth oxysulphide and mixtures thereof.

Preferably, hot metal is treated in a ladle or transfer car with rare earth oxides, by the simple addition and mixing of the rare earth oxides, by an injection technique in which the rare earth oxides are injected into the molten bath in a carrier gas such as argon or nitrogen or by the use of an "active lining" i.e., a rare earth oxide lining in the vessel. In any case, the chemical reactions involved are:

$$2CeO_{2(s)} + [C] = Ce_2O_{3(s)} + CO_{(g)} \quad (1)$$

$$RE_2O_{3(s)} + [C] + [S]_{1w/o} = RE_2O_2S_{(s)} + CO_{(g)} \quad (2)$$

and $$RE_2O_2S_{(s)} + 2[C] + 2[S]_{1w/o} = RE_2S_{3(s)} + 2CO_{(g)} \quad (3)$$

The product sulphide or oxysulphide will be fixed in an 'active' lining or removed by flotation and absorbed into the slag cover and vessel lining depending upon the process used for introducing the rare earth oxide.

The products of desulphurization of carbon saturated iron with RE oxides is dependent on the partial pressure of CO, pCO, and the Henrian sulphur activity in the metal, $h_S$. Using cerium as the representative rare earth, the following standard free energy changes the equilibrium constants at 1500° C for different desulphurization reactions can be calculated from thermodynamic data in the literature:

| REACTION | ΔG° cal. | $K_{1773}$ |
|---|---|---|
| $2CeO_{2(s)} + [C] = Ce_2O_{3(s)} + CO_{(g)}$ | 66000 − 53.16T | pCO = 3041 |
| $Ce_2O_{3(s)} + [C] + [S]_{1w/o} = Ce_2O_2S_{(s)} + CO_{(g)}$ | 18220 −26.43 T | $pCO/h_S = 3395$ |
| $Ce_2O_2S_{(s)} + 2[C] + 2[S]_{1w/o} = Ce_2S_{3(s)} + 2CO_{(g)}$ | 66180 − 39.86T | $p^2CO/h_S^2 = 3.6$ |
| $3/2\ Ce_2O_2S_{(s)} + 3[C] + 5/2[S]_{1w/o} = Ce_3S_{4(s)} + 3CO_{(g)}$ | 127050 − 72.1T | $p^3CO/h_s^{3/2} = 1.25$ |
| $Ce_2O_2S_{(s)} + 2[C] + [S]_{1w/o} = 2CeS_{(s)} + 2CO_{(g)}$ | 120,860 − 61.0T | $p^2Co/h_S = .027$ |
| $C_{(s)} + 1/2\ O_{2(g)} = CO_{(g)}$ | −28200 − 20.16T | $pCO/p^{1/2}O_2 = 7.6 \times 10^{-7}$ |
| $1/2S_{2(g)} = [S]_{1w/o}$ | −31520 + 5.27T | $h_S/p^{1/2}S_2 = 5.4 \times 10^2$ |

The thermodynamics of desulphurization with lanthanium oxide, $La_2O_3$, are similar although, in this case, $LaO_2$ is unstable and there will be no conversion corresponding to $CeO_2 \rightarrow Ce_2O_3$.

In the foregoing general description of this invention, certain objects, purposes and advantages have been outlined. Other objects, purposes and advantages of this invention will be apparent, however, from the following description and the accompanying drawings in which:

FIG. 1 is a stability diagram showing w/o sulphur as partial pressure of CO;

FIGS. 2*a* and 2*b* show $Ce_2S_3$ and $Ce_2O_2S$ layers on a pellet of $CeO_2$;

Referring back to the discussion of free energy set out above, it is clear that these free energy changes may be used to determine the fields of stability of $Ce_2O_3$, $Ce_2O_2S$, $Ce_2S_3$, $Ce_3S_4$ and CeS in terms of the partial pressure of CO and the Henrian sulphur activity of the melt at 1500° C. The resultant stability diagram is shown in FIG. 1, the boundaries between the phase fields being given by the following relationships:

| BOUNDARY | EQUATION |
|---|---|
| $Ce_2O_3 - Ce_2O_2S$ | $\log pCO = \log h_S + 3.53$ |
| $Ce_2O_2S - Ce_2S_3$ | $\log pCO = \log h_S + 0.28$ |
| $Ce_2O_2S - Ce_3S_4$ | $\log pCO = 0.83 \log h_S + 0.03$ |
| $Ce_2O_2S - CeS$ | $\log pCO = 0.5 \log h_S - 0.79$ |
| $Ce_2S_3 - Ce_3S_4$ | $\log h_S = -1.47$ |
| $Ce_3S_4 - CeS$ | $\log h_S = -2.45$ |

The phase fields in FIG. 1 are also shown in terms of the Henrian activity of oxygen, $h_O$, and the approximate [w/o S] in the iron melt using an activity coefficient $f_S \simeq 5.5$ for graphite saturated conditions.

The coordinates of the points B, C, D and E on the diagram are given below:

| COORDINATES | B | C | D | E |
|---|---|---|---|---|
| pCO atm. | $9.8 \times 0\ 10^{-3}$ | $6.5 \times 10^{-2}$ | 1.0 | 1.0 |
| $h_S$ | $3.5 \times 10^{-3}$ | $3.4 \times 10^{-2}$ | $5.3 \times 10^{-1}$ | $2.9 \times 10^{-4}$ |
| Approx. [w/o S] | $6.4 \times 10^{-4}$ | $6.2 \times 10^{-3}$ | $9.6 \times 10^{-2}$ | $5.3 \times 10^{-5}$ |

The points B and C represent simultaneous equilibria between the oxysulphide and two sulphides at 1500° C. These univariant points are only a function of temperature. The points E and D represent the minimum sulphur contents or activities at which oxysulphide and $Ce_2S_3$ can be formed, respectively, at pCO = 1 atm. Thus, carbon saturated hot metal cannot be desulphurized by oxysulphide formation below $h_S \approx 2.9 \times 10^{-4}$ ([w/o S] $\simeq 5.3 \times 10^{-5}$) at pCO = 1 atm. However, lower sulphur levels may be attained by reducing the partial pressure of CO.

The conversion of $CeO_2 \rightarrow Ce_2O_3 \rightarrow Ce_2O_2S \rightarrow Ce_2S_3$ is illustrated in FIGS. 2*a* and 2*b* which show $Ce_2S_3$ and $Ce_2O_2S$ layers on a pellet of $CeO_2$ (which first transformed to $Ce_2O_3$) on immersion in graphite saturated iron at ~ 1600° C, initially containing 0.10 w/o S, for 10 hours. The final sulphur content was ~ 0.03 w/o S and the experiment was carried out under argon, where pCO << 1 atm.

The conversion of the oxide to oxysulphide and sulphide is mass transfer controlled and, as in conventional external desulphurization with $CaC_2$, vigorous stirring will be required for the simple addition process and circulation of hot metal may be required in the 'active' lining process.

Figure 3:
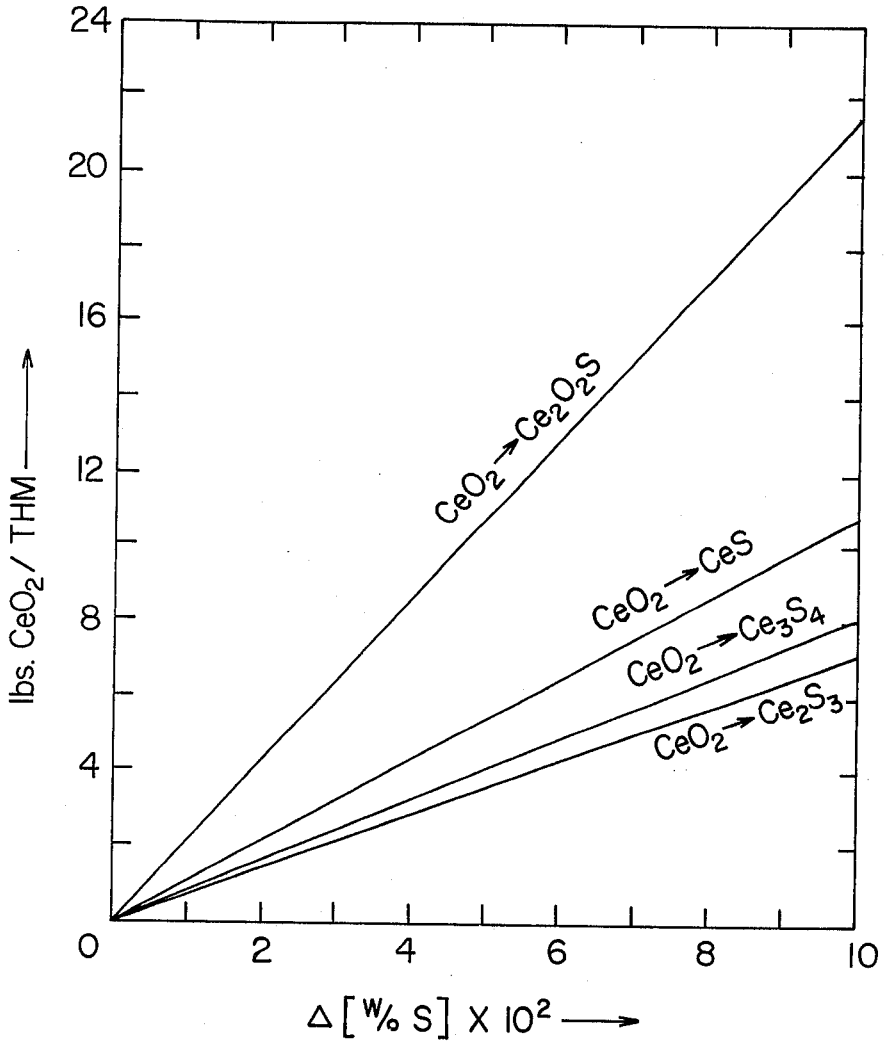
FIG. 3 is a graph of the theoretical $CeO_2$ required for removal of 0.01 w/o S/THM.

From FIG. 1 it is apparent that the external desulphurization of graphite saturated iron is thermodynamically possible using RE oxides. For example the diagram indicates that hot metal sulphur levels of ~ 0.5 ppm (point E) can be achieved by cerium oxide addition even at pCO = 1 atm. Desulphurization in this case will take place through the transformation sequence $CeO_2 \rightarrow Ce_2O_3 \rightarrow Ce_2O_2S$ which required 2 moles of $CeO_2$ to remove 1 gm. atom of sulphur. The efficiency of sulphur removal/lb $CeO_2$ added can however be greatly increased by the formation of sulphides. 1 mole $CeO_2$ is required per g. atom of sulphur for CeS formation and 2/3 moles $CeO_2$ for $Ce_2S_3$ formation. The theoretical $CeO_2$ requirements for the removal of 0.01 w/o S/THM for the various desulphurization products are given below and expressed graphically in FIG. 3.

| PRODUCT | lb $CeO_2$/0.01 w/o S.THM | $ft^3CO$/lb $CeO_2$ | $ft^3CO$/0.01 w/o S.THM |
|---|---|---|---|
| $Ce_2O_2S$ | 2.15 | 2.1 | 4.5 |
| CeS | 1.1 | 4.2 | 4.5 |
| $Ce_3S_4$ | 0.8 | 4.2 | 3.4 |
| $Ce_2S_3$ | 0.7 | 4.2 | 3.0 |

The volume of carbon monoxide produced in $ft^3CO$/lb $CeO_2$ and $ft^3CO$/0.01 w/o S.THM are also given in the above table for each desulphurization product. For efficient desulphurization the partial pressure of carbon monoxide should be sufficiently low to avoid oxysulphide formation. For example, FIG. 1 shows that oxysulphide will not form in a graphite saturated melt until [w/o S] < 0.01 when pCO ≃ 0.1 atm. It will form however when [w/o S] ≃ 0.10 at pCO = 1 atm. Thus by reducing the pCO in the desulphurization process to 0.1 atm., hot metal can be desulphurized to 0.01 w/o S with a $CeO_2$ addition of 0.72 lb/0.01 w/o S removed for each ton hot metal.

The choice of the method of reducing the partial pressure of carbon monoxide depends on economic and technical considerations. However, in an injection process calculations can be made for the volume of injection gas, say nitrogen, required to produce a given pCO. Thus:

$$V_{N_2} = V_{CO}(1\text{-}p\text{CO})/p\text{CO}$$

where $V_{CO}$ is the scf of CO formed/lb $CeO_2$ added $V_{N_2}$ is the scf of $N_2$ required/lg $CeO_2$ added and

*p*CO is the desired partial pressure of CO in atm.

Figure 4:
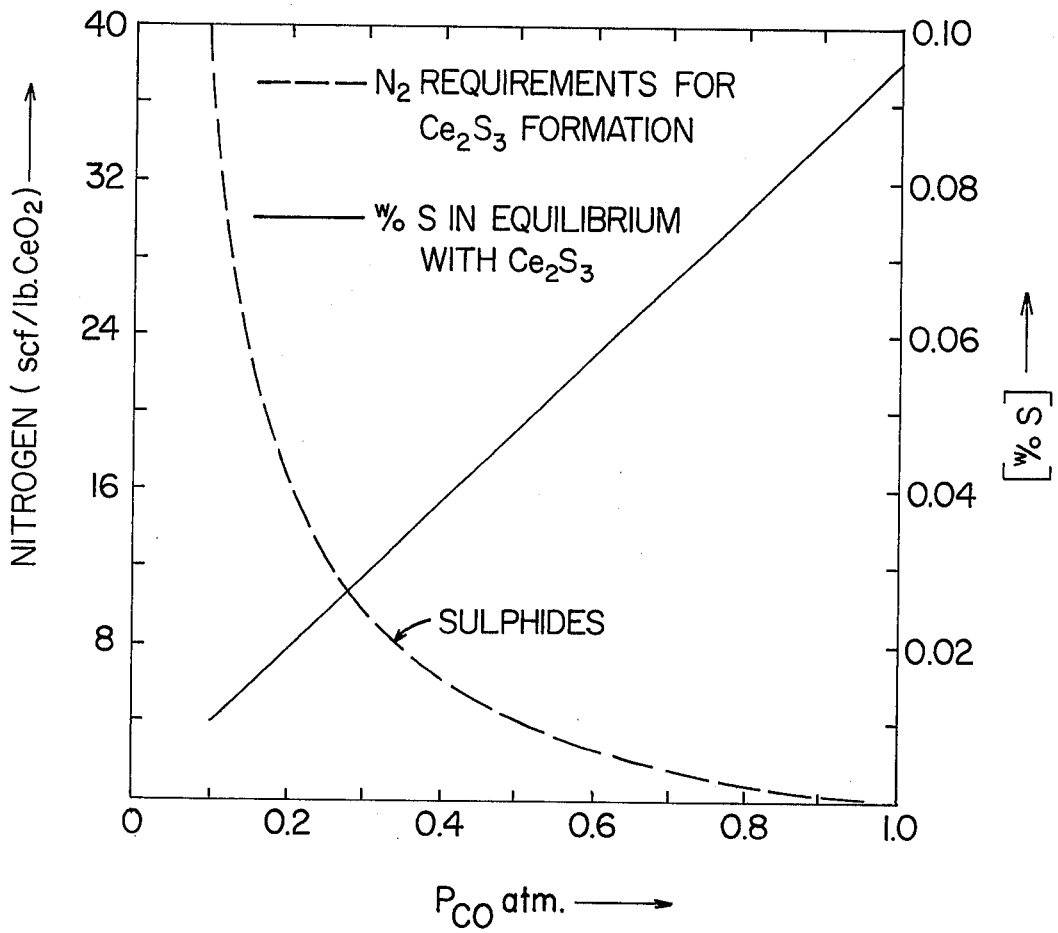
FIG. 4 is a graph showing the volume of nitrogen required to produce a given partial pressure of CO.

The results of these calculations for $Ce_2S_3$ formation are shown in FIG. 4, which also shows the [w/o S] in equilibrium with $Ce_2S_{3(s)}$ as a function of pCO. From this figure is is apparent that the volume of $N_2$/lb $CeO_2$ required to form $Ce_2S_3$ is excessive and if an injection process were used a balance would have to be struck between sulphide and oxysulphide formation. When, for example, hot metal is to desulphurized from 0.05 to 0.01 w/o S at pCO = 0.2 atm., ~16 scf $N_2$/lb $CeO_2$ would be required for $Ce_2S_3$ formation and the sulphur content would drop to 0.02 w/o. The remaining 0.01 w/o S would be removed by oxysulphide formation. From FIG. 3, it can be seen that ~2 lbs of $CeO_2$/THM would be required for $Ce_2S_3$ formation and 2 lbs for $Ce_2O_2S$ formation giving a total requirement of 4 lbs $CeO_2$/THM.

Figure 5:
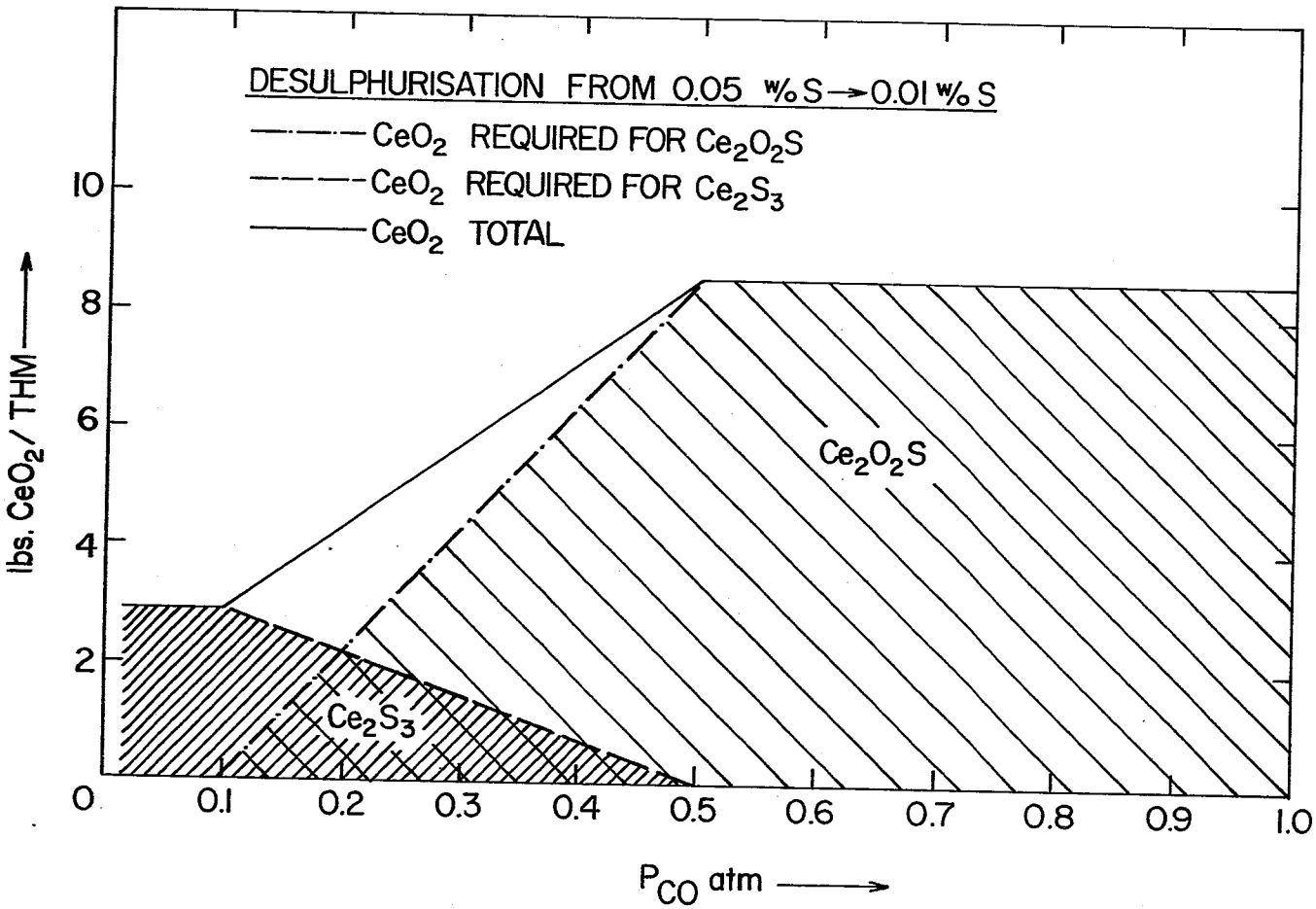
FIG. 5 is a graph showing the $CeO_2$ requirements as a function of partial pressure of CO.

Calculations similar to the one above have been used to construct FIG. 5 where the $CeO_2$ requirements in lbs/THM are shown as a function of pCO.

When large volumes of nitrogen are used in an injection process the heat carried away by the nitrogen, as sensible heat, is not large but the increased losses by radiation may be excessive. Injection rates with $CaC_2$ for example are in order of 0.1 scf $N_2$/lb $CaC_2$.

Vacuum processing is an alternative method of reducing the partial pressure of carbon monoxide. This is impractical in hot metal external desulphurization but not in steelmaking (see below).

Still another alternative approach to external desulphurization using rare earth oxides is the use of active linings which would involve the 'gunning' or flame-spraying of HM transfer car linings with rare earth oxides. Here the oxides would transform the oxysulphides during the transfer of hot metal from the blast furnace to the steelmaking plant, an the oxide would be regenerated by atmospheric oxidation when the car was emptied. It is estimated that for a 200 ton transfer car, conversion of a 2 mm layer (~0.080 inch) of oxide to oxysulphide would reduce the sulphur content of the hot metal by ~0.02 w/o S. This process has the following advantages:

1. continuous regeneration of rare earth oxide by atmospheric oxidation when the car is empty,
2. reaction times would be in the order of hours,
3. the absence of a sulphur rich desulphurization slag,
4. the absence of suspended sulphides in the hot metal.

The mechanical integrity and the life of an "active" lining is, of course, critical and some pollution problems may be associated with oxide regeneration by atmospheric oxidation.

With regard to steelmaking applications, vacuum desulphurization could be carried out by an "active"

lining in the ASEA-SKF process and circulation vacuum degassing processes.

In the case of desulphurization, assuming the following gas composition at 1000° C:

| Component | Vol. % |
|---|---|
| $CO_2$ | 16 |
| CO | 40 |
| $H_2$ | 40 |
| $N_2$ | 4 |
| $H_2S$ | 0.3 (200 grains/100 ft$^3$.) |

Figure 6:
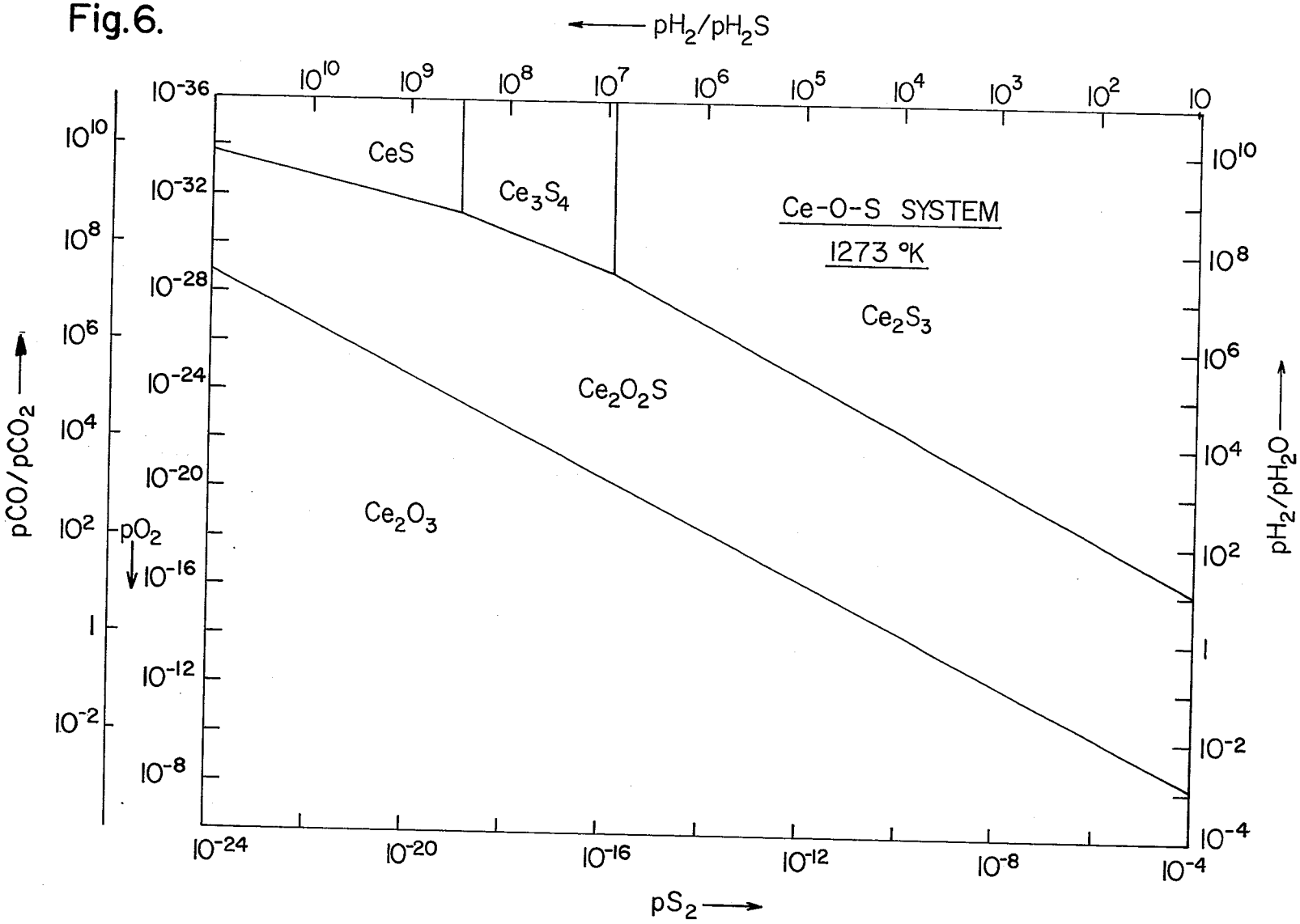
FIG. 6 is a stability diagram for stack gas systems treated according to this invention.

This equilibrium gas composition is represented by point A on the diagram illustrated as FIG. 6 where $CO/CO_2 = 2.5$ and $H_2/H_2S = 133$. This point lies within the $Ce_2O_2S$ phase field and at constant $CO/CO_2$ desulphurization with $Ce_2O_3$ will take place up to point B. At point B, $H_2/H_2S \simeq 10^4$ and the concentration of $H_2S$ is 0.004 vol.% (~3 grains/100 ft.$^3$). Beyond this point, desulphurization is not possible.

In the foregoing specification, we have set out certain preferred practices and embodiments of our invention, however, it will be understood that this invention may be otherwise embodied within the scope of the following claims.

We claim:

1. A method of desulphurizing molten iron, steel, stack gases containing sulfur as an impurity comprising the steps of:

a. reacting rare earth oxide in the presence of one of a separate deoxidizing agent and a deoxidizing atmosphere with sulphur to be removed to form one of the group consisting of rare earth sulphides and rare earth oxysulphides and mixtures thereof, and b. removing said oxysulphides and sulphides.

2. The method of desulphurizing molten iron, steel, stack gases and like materials containing sulfur as an impurity as claimed in claim 1 wherein the oxygen potential is maintained at a low level by reducing the partial pressure of CO.

3. The method of claim 2 wherein the partial pressure of CO is maintained below about 0.1 atmosphere.

4. The method of desulphurizing molten iron and steel as claimed in claim 1 wherein rare earth oxide is added to a molten bath of metal by injecting the rare earth oxide beneath the surface of the molten bath in a stream of inert gas sufficient to dilute carbon monoxide formed in the reaction to a level below about 0.1 atmosphere.

5. The method of desulphurizing molten iron and steel as claimed in claim 4 wherein the inert gas is nitrogen.

6. The method of desulphurizing molten iron and steel as claimed in claim 1 wherein rare earth oxide is added to a molten bath of metal subject to a vacuum sufficient to maintain the partial pressure of carbon monoxide below about 0.1 atmosphere.

7. The method of desulphurizing molten iron and steel as claimed in claim 1 wherein the molten metal is poured into a vessel having a lining surface of rare earth oxides.

8. The method of desulphurizing molten iron and steel as claimed in claim 7 wherein the rare earth oxide lining is at least 2 mm in thickness.

9. The method of desulphurizing molten iron and steel as claimed in claim 7 wherein the vessel lining of rare earth is regenerated with oxygen after the desulphurized molten metal is discharged prior to pouring another bath of molten metal into said vessel.

10. The method of desulphurizing molten iron and steel as claimed in claim 7 wherein the vessel is subjected to a vacuum sufficient to maintain a partial pressure of carbon monoxide below 0.1 atmosphere.

* * * * *

UNITED STATES PATENT OFFICE

CERTIFICATE OF CORRECTION

Patent No. 4,084,960 Dated April 18, 1978

Inventor(s) D. Alan R. Kay and William G. Wilson

It is certified that error appears in the above-identified patent and that said Letters Patent are hereby corrected as shown below:

Column 1, line 8, "desulpherizing" should read --desulphurizing--;

Column 1, line 16, in the Table, "Ce2 " (second occurrence) should read --$Ce_2$--;

Column 2, line 1, after "will" insert --either--;

Column 3, line 16, " ≈ " should be -- ≃ --;

Column 4, line 14, "lg" should be --lb--;

Column 4, line 19, "is" (first occurrence) should be --it--; and

Column 4, line 50, "an" should read --and--.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*